United States Patent [19]

Leivenzon et al.

[11] 4,342,354

[45] Aug. 3, 1982

[54] MECHANISM FOR STOPPING THE DRIVE OR REVERSING THE DRIVE OF MOTORS OF ROLLER SHUTTER DOORS

[75] Inventors: Simon Leivenzon; Steven Leivenzon, both of Caulfield, Australia

[73] Assignee: Firmaframe Nominees Pty. Ltd., Cheltenham, Australia

[21] Appl. No.: 163,715

[22] Filed: Jun. 27, 1980

[30] Foreign Application Priority Data

Jul. 4, 1979 [AU] Australia ..... PD9454

[51] Int. Cl.[3] ..... E06B 9/204; E06B 9/209; E06B 9/10

[52] U.S. Cl. ..... 160/133; 49/28; 49/139; 160/310; 160/311; 192/141; 192/150

[58] Field of Search ..... 160/133, 310, 311; 49/28, 139, 140, 199; 192/141, 150; 74/405, 406; 318/266, 475

[56] References Cited

U.S. PATENT DOCUMENTS

| | | | |
|---|---|---|---|
| 1,551,512 | 8/1925 | Goff | 192/141 |
| 1,649,797 | 11/1927 | Winn | 160/310 X |
| 2,110,231 | 3/1938 | McCloud | 160/310 X |
| 2,819,628 | 1/1958 | Wardlaw | 160/310 |
| 3,026,744 | 3/1962 | Rouse | 74/405 X |
| 3,202,415 | 8/1965 | Lodge | 49/28 |
| 3,439,727 | 4/1969 | Perl | 49/28 X |
| 3,559,024 | 1/1971 | Marder | 318/266 X |
| 4,107,877 | 8/1978 | Lee | 192/141 X |
| 4,154,144 | 5/1979 | Lyman | 74/405 X |

*Primary Examiner*—Rodney H. Bonck

*Attorney, Agent, or Firm*—Dennison, Meserole, Pollack & Scheiner

[57] ABSTRACT

A roller shutter door limit sensing means comprising a screw member for rotation in response to rotation of the drum onto which the curtain of the roller shutter door is wound, a limit switch actuator means threadably carried by the screw member to advance or retreat therealong in response to its rotation operates a corresponding opposite limit switch means, whereby the switch means can be activated for the curtain fully closed or the curtain fully opened positions whereby to switch off an electric drive means which opens or closes said roller shutter door.

A roller shutter door sensing means is also provided for sensing increased pressure on closing of the door and to open the door in response to detecting such increased pressure which is representative of an object under the door comprising: said motor being mounted on a swingable arm and biased to drive engage with the drum, the swinging being such that if increased driving pressure is required, then the motor tends to move out of drive engagement by swinging on the arm, thereby activating a sensing means which does not swing which reverses direction of rotation of the motor to open the door curtain.

6 Claims, 6 Drawing Figures

MECHANISM FOR STOPPING THE DRIVE OR REVERSING THE DRIVE OF MOTORS OF ROLLER SHUTTER DOORS

This invention relates to an improved mechanism for stopping the drive or reversing the drive of motors of roller shutter doors.

Hitherto in the art of operator mechanism for roller shutter doors there has been a provision to switch off the drive to the motor when the door is driven to the fully closed or fully opened positions. Additionally, there has been a provision for reversing the drive of the motor should the door on closing strike an object under the door. This provision is provided so that the door will re-open automatically thereby enabling the object such as a child to escape without injury. One known form of sensing means for sensing the fully closed and fully opened position comprises micro-switches suitably positioned on a door frame. The problem with this arrangement is that when the operator mechanism is sold as a unit for fitting to the door, it has many pieces which are required to be located in remote positions. For the home handyman as well as the experienced professional, fitting of the required components into the desired location and or accurately aligning them to operate is a relatively difficult task. Moreover the fact that the micro-switches are remote from the operator mechanism as a whole is undesirable as it requires wires to be fed to the micro-switches and concealed in a suitable manner. Another problem with the drive mechanism of roller shutter doors is that it has been very costly to provide a mechanism which senses when the door strikes an object during closing and changes the direction of the driving of the motor to open the door. Hitherto, there has been sensing means placed between drive gears of the drive train from the motor to the drum on which the door curtain is wound. The particular arrangement provided in the prior art involves many gears in the drive train and complicated mechanisms.

Accordingly, it is an object of the present invention to provide an improved construction.

According to a first aspect of the present invention there may be provided a roller shutter door limit sensing means comprising a worm thread for rotation with the drum onto which the curtain of the roller shutter door is wound, a carriage or a switch means carried by the worm thread to advance or retreat along the length of the worm thread in response to rotation of the worm thread, a corresponding opposite carriage or switch means mounted to be operative with the opposite carriage or switch means on the worm thread, said carriage having adjustable limit stop means thereon whereby the switch means can be activated for the curtain fully closed or the curtain fully opened positions.

According to a second aspect of the present invention there is provided a roller shutter door sensing means for sensing increased pressure on closing of the door and to open the door in response to detecting such increased pressure said increased pressure being representative of an object under the door comprising: a motor for driving a drum onto which the curtain is wound and unwound, said motor being mounted on a swingable member and biased to drive engage with the drum, the swinging being such that if increased driving pressure is required then the motor tends to move out of drive engagement by swinging on the arm, thereby activating means which reverses direction of rotation of the motor to open the door curtain.

In order that the invention can be more clearly ascertained preferred constructions will now be described with reference to the accompanying drawings wherein.

Figure 1:
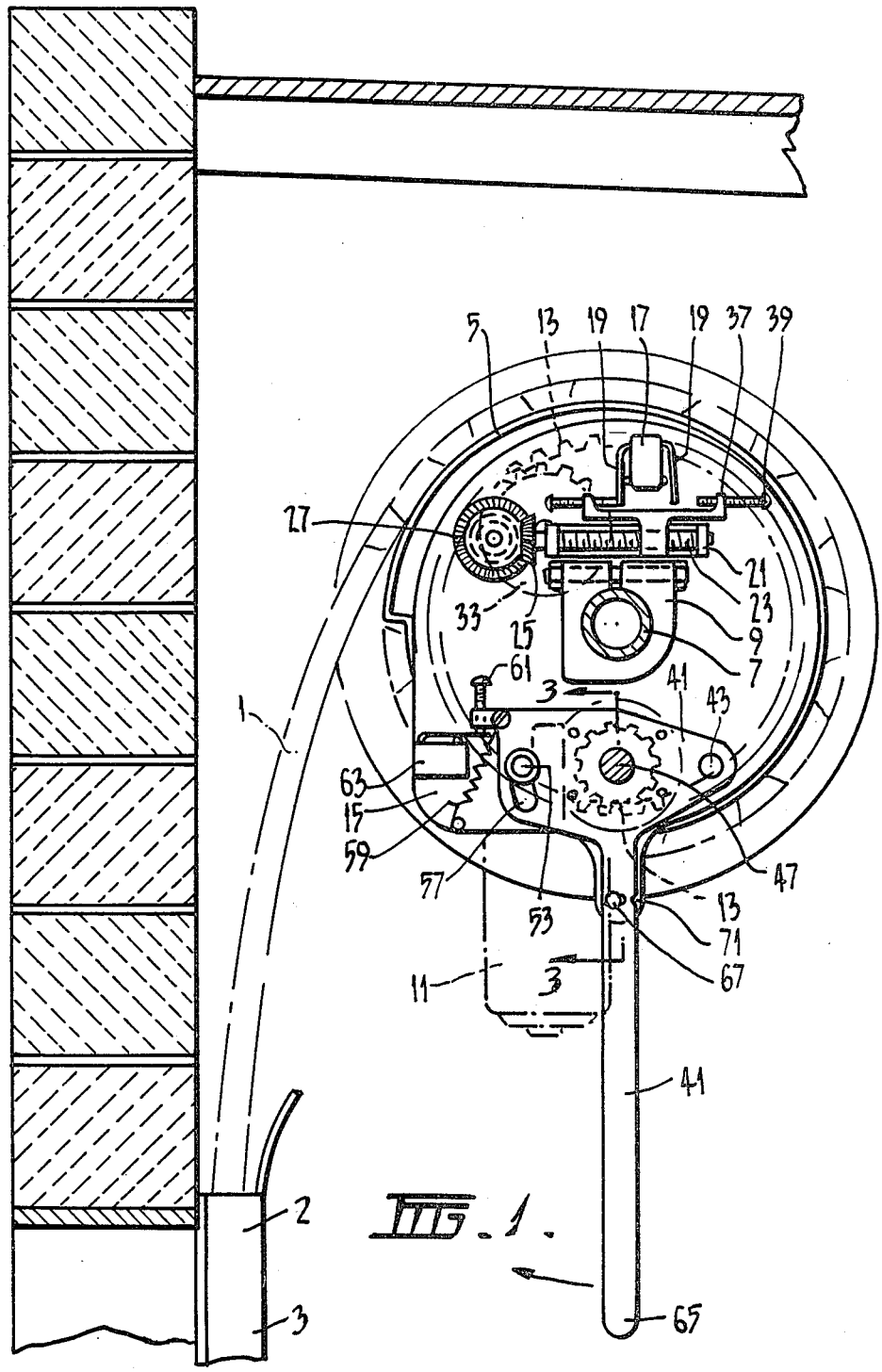
FIG. 1 is an end view of a drum on which the roller door curtain is wound, showing both the limit stop means and the reversing means for detecting when an object is under the door.

Referring now to FIG. 1 there is shown a door curtain 1 which slides in a guide 2 which forms part of a door frame attached to the front wall of a building around an opening in which the door 1 is situated. The curtain 1 is wound around a drum 5 and the drum 5 has an axle 7 which is suitably supported at both ends of the drum 5 to the door frame 3 or to the wall of the building by brackets 9. The exact means of supporting the brackets 9 relative to the frame 3 has not been shown in order to aid clarity of the drawing, however, it comprises an extension which is arranged to be clamped, by bolts, to the frame 3 or the wall. A D.C. electric motor 11 is arranged to drive an internal ring gear 13 within the drum 5 so as to wind or unwind the curtain 1 onto the drum 5. An end plate 15 is carried by the bracket 9 at one end of the drum 5 and supports the necessary sensing means to be described hereinafter. The end plate 15 remains stationary relative to the drum 5 during rotation of the drum 5.

Figure 2:
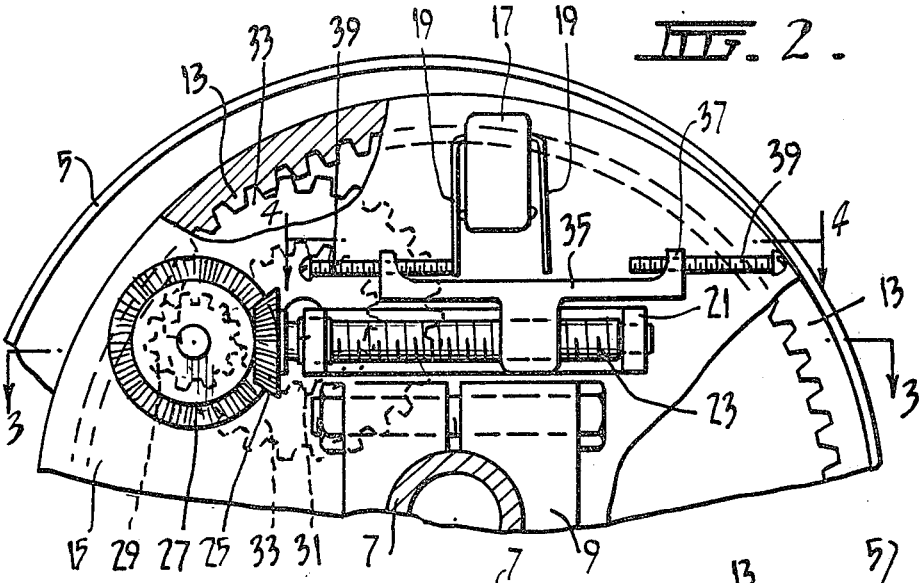
FIG. 2 is a close up end view of the limit stop means shown in FIG. 1.
Figure 3:
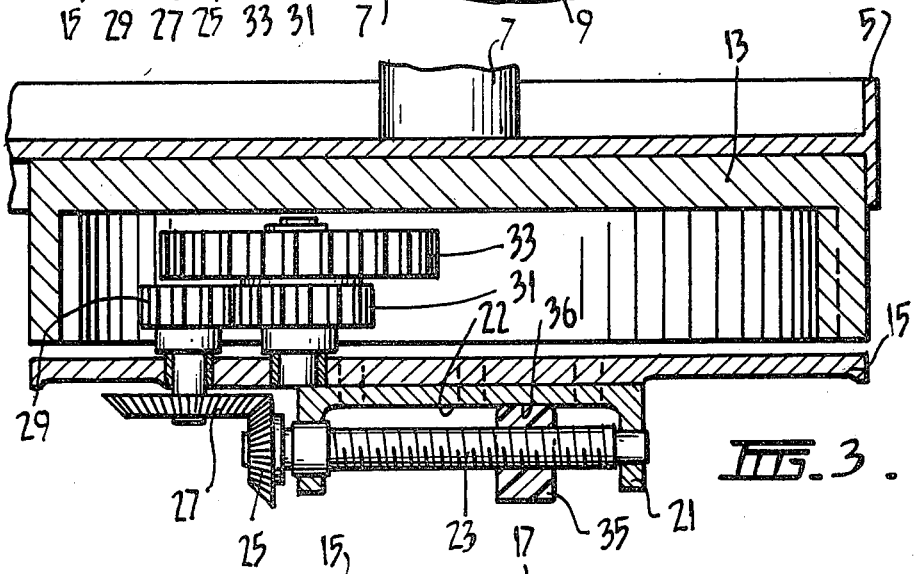
FIG. 3 is a plan sectional view taken along line 3—3 of FIG. 2.
Figure 4:
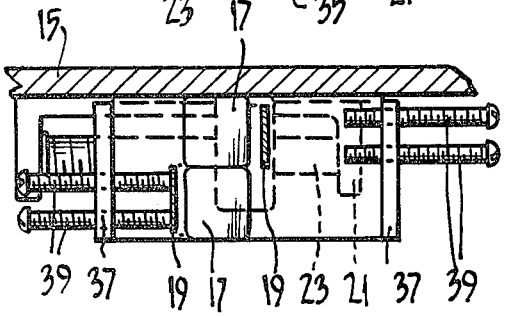
FIG. 4 is a detailed sectional plan view taken along line 4—4 of FIG. 2.

The sensing means for sensing the fully closed and fully opened positions of the curtain 1 of the door will now be described in detail. Two limit switches 17 —shown one behind the other in FIGS. 1 and 2—are fastened to the end plate 15 in the position shown. The limit switches 17 each have arms 19 which depend downwardly and operate respective contacts within the switches 17. Each limit switch 17 is connected with suitable electronic circuitry so as to stop rotation of the motor 11 by disconnecting the D.C. voltage supplied thereto. Simultaneously the switches 17 are arranged to reverse the polarity of the voltage applied to the motor 11 so that when the door 1 is to move in the reverse direction, then the voltage is correctly applied with required polarity to reverse the direction of rotation of the motor. A U shaped bracket 21 is fastened to the end plate 15 in the position shown and has a worm thread or screw 23 suitably journalled therein. The worm thread 23 is journalled for rotation about its longitudinal axis relative to the U shaped bracket 21. Mounted on the end of the worm thread 23 is a bevel pinion gear 25 which meshes with a bevel crown gear 27 which is journalled on a shaft which protrudes through the end plate 15 and carries a spur gear 29 thereon. Spur gear 29 meshingly engages with a further spur gear 31 journalled in the end plate 15 for rotation about its central axis. Attached to the rear of spur gear 31 is a further spur gear 33 which meshes with the teeth on the ring gear 13. In use, when the drum 5 rotates, ring gear 13 rotates therewith and drives the gear through the gear train 33, 31, 29, 27 and 25, to in turn, rotate the worm thread 23. Worm thread 23 carries a carriage member 35 which advances or retreats along the worm thread 23 relative to the pinion 25. The carriage member 35 has upstanding ends 37 which carries screw thread adjusting members 39. The screw thread adjusting members 39 are provided so that they can be adjusted to provide the required spacing between the open and closed positions respectively of the carriage member 35 along the worm gear 23. Thus, when the door is in the closed position one pair of the adjusting means 39 operates one of the arms 19 of the switch 17 and when the door is in the other position the other adjusting means 39 operates the other arm 19 of the other switch 17. The carriage member is prevented from rotating with the worm thread 23 by the rear face 36 slidingly engaging with the inside face 22 of the 'U' shaped bracket 21.

With the device illustrated it is possible to accurately adjust the door for closing precisely to the fully closed and fully opened positions and to stop the motor 11 at those positions. Lock-nuts, not shown, are screw threaded on to the adjusting means 39 to lock them in the set positions.

Figure 5:
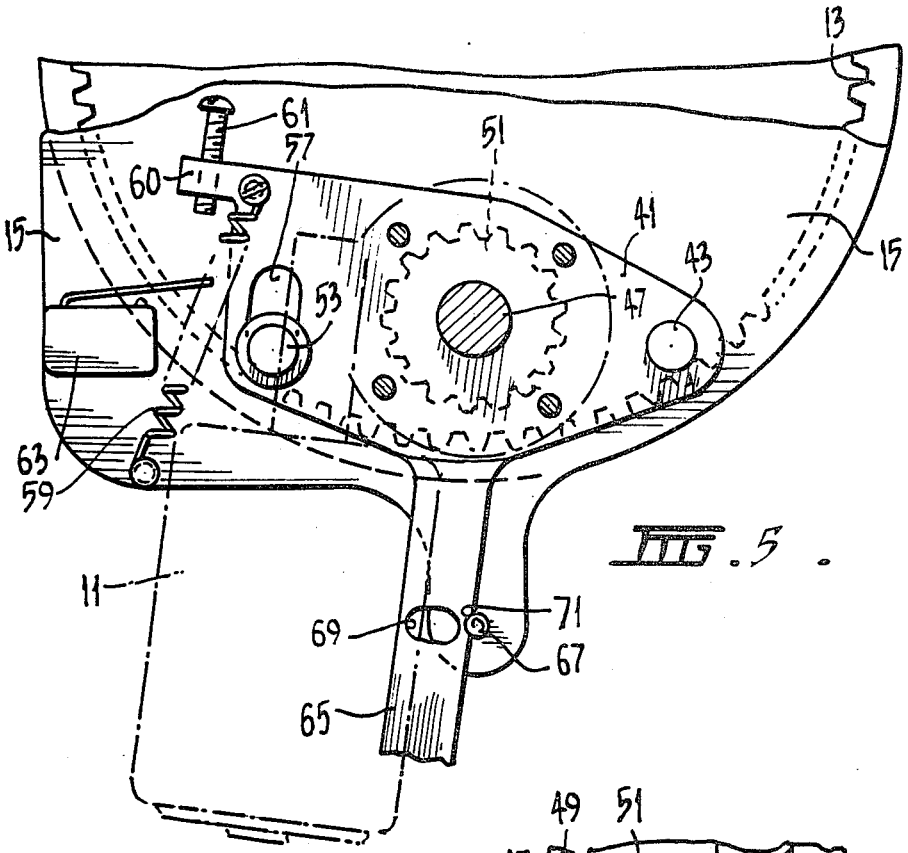
FIG. 5 is a close up end view of the reversing sensor means for detecting an object underneath the door curtain, and, FIG. 6 is a detailed sectional view showing the drive train from the motor to the drum.
Figure 6:
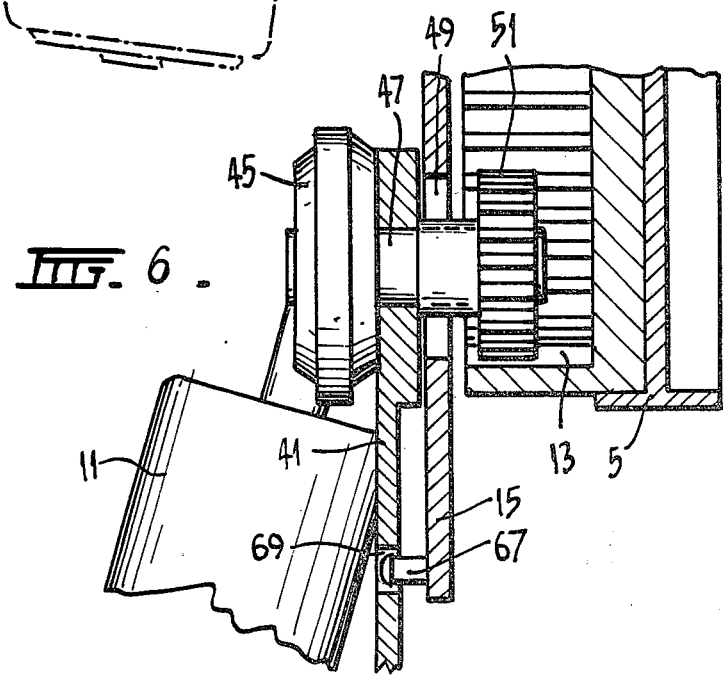

Reference will now be made to the automatic reversing mechanism for sensing increased resistance to closing of the curtain of the door as would be occasioned by an object being under the curtain 1 during closing. Reference is specifically made to FIGS. 1, 5 and 6. The motor 11 is mounted on a swingable arm member 41 which is mounted to the end plate 15 so as to swing about pivot 43. The motor 11 is of known configuration which has an angle drive head 45. The output shaft 47 of the motor 11 passes through the end plate 15 through an elongate slot 49 (see FIG. 6). The shaft 47 has a pinion gear 51 mounted thereon and is arranged for meshing engagement with the ring gear 13. The plate 41 has a guide pin 53 fastened to the end plate 15 and spaced from the pivot 43. The guide pin 53 has a head thereon which retains the plate 41 captive relative to the end plate 15 but so that it can swing parallel thereto about pivot 43. The guide pin 53 locates within an elongate slot 57 and a spring 59 connected between an end of the arm member 41 and the end plate 15 applies a bias to urge the gear 51 into meshing engagement with the ring gear 13. This is shown in FIG. 1. At the end of the arm member 41, remote from the pivot 43 is a protruding arm 60 which carries an adjustable striker 61. Mounted on the backing plate 15 and in the path of swinging of the striker 61 is a further micro switch 63. In normal use the micro switch is depressed, maintaining a circuit closed to supply the necessary voltage to the motor 11 to move the curtain 1 of the door to the closed position. The spring 59, maintains the gear 51 in mesh with the ring gear 13 during this movement. If an object should be under the curtain 1 of the door, then as soon as the curtain 1 strikes that object, an increased pressure will be transmitted through the drive of the motor and through the gears 51 onto the ring gear 13. This will cause the gear 51 to crank about the pivot 43 with the gears 51 and 13 tending to move out of meshing engagement. Such movement will cause the arm 60 and the striker 61 to move away from the switch 63 thus opening the circuit of the switch 63. Once the circuit of the switch 63 is opened then the electric circuit is arranged to reverse the polarity of the voltage to the motor 11 and thus open the door by driving the drum 5 in the opposite direction. Once the resistance to closing is overcome by the motor driving in the opposite direction, then the spring 59 will urge the gears 51 and 13 into full meshing driving engagement.

In order that the curtain 1 can be opened manually, rather than by the motor 11, then it is necessary to disengage drive from the gear 51 to the ring gear 13. This is achieved by moving an arm member 65 which is an extension of the arm member 41 outwardly relative to the plate 15 so that a pin 67 does not locate within a slot 69 in the arm member 65, thus cranking the gear 51 out of drive engagement with the ring gear 13. In order to locate the gear 51 in the non drive position the pin 67 can locate behind the arm 65 in a notch therein. The notch is shown in FIG. 1 by numeral 71.

The electric circuitry for operating the motor 11 in association with the switches 17 and 63 has not been shown herein as it does not form part of the present inventive structure. It is considered that such circuitry can be readily determined by a person skilled in the electric control arts without requiring inventive skill.

It will be appreciated that the switch means 19 could be mounted on the carriage member 35 and that a post or stops with adjustable limits be provided on the end plate 15, so that the switch is movable instead of the stop means. Such an alternative construction is within the scope of the present invention.

We claim:

1. A roller shutter door with limit switch sensing means comprising:

(a) a door curtain;

(b) drum means upon which the door curtain is to be wound, the upper portion of the curtain being secured to the drum means;

(c) an internal ring gear mounted with its central longitudinal axis in line with the central longitudinal axis of said drum means and attached thereto;

(d) a reversible electric motor means having a pinion gear drivably connected therewith and arranged to mesh with said ring gear whereby to drive said drum to wind the curtain on and off the drum for closing and opening the door respectively;

(e) a gear train drivably connected with said ring gear and including an elongate screw thread, the longitudinal axis of which extends substantially perpendicular with the central longitudinal axis of said drum means and immediately adjacent said ring gear and between the circumferential edge surfaces thereof;

(f) a carriage, said carriage being threaded on said screw thread and restrained from rotating with said screw thread but being able to be advanced or retreated along said screw thread as said screw thread is rotationally driven by said gear train, said carriage having two end flanges spaced apart in a direction substantially parallel with the longitudinal axis of said screw thread;

(g) limit switch means supported between said flanges, and;

(h) respective screw thread limit stop adjusting means carried by each of said flanges whereby the limit switch means can be activated by said respective screw thread limit stop adjusting means when the door curtain is at the fully closed or fully open positions to switch off said reversible electric motor means.

2. A roller shutter door as claimed in claim 1 wherein said carriage is restrained from rotating by restraining surfaces comprising a side surface of said carriage, and surfaces of a bridging part of a 'U' shaped bracket member supported by a non-movable part of the assembly, said 'U' shaped bracket member having said screw thread journalled therein at the free end of the arms thereof.

3. A roller shutter door as claimed in claim 1 wherein said reversible electric motor means is mounted on arm means which is mounted for swinging movement about an axle, the central longitudinal axis of said axle being substantially parallel with the central longitudinal axis of said drum means and spaced from the central axis of the pinion, said swinging being such that the reversible electric motor means can be drive engaged or disengaged with said internal ring gear by swinging about said axle whereby to allow said door curtain to be opened manually in the event of power failure by disengaging said drive.

4. A roller shutter door as claimed in claim 3 and further including spring means for biasing said arm means to provide engaged drive between said reversible electric motor means and said internal ring gear and wherein switch means is provided between said arm means and a non-rotatable part of the assembly so that if increased loading is placed on the reversible electric motor means by an obstruction being under the door curtain during closing, then the arm means will swing about said axle and operate said switch means to cause the direction of rotation of the reversible electric motor to change to reopen the door curtain.

5. A roller shutter door comprising:

(a) a door curtain;

(b) drum means upon which the door curtain is to be wound, the upper portion of the curtain being held to the drum means;

(c) an internal ring gear mounted with its central longitudinal axis in line with the central longitudinal axis of said drum means and attached thereto;

(d) a reversible electric motor means having a pinion gear drivably connected therewith and arranged to mesh with said ring gear whereby to drive said drum to wind the curtain on and off the drum for closing and opening the door respectively;

(e) arm means, said reversible electric motor means being mounted on said arm means which is mounted for swinging movement about an axle, the central longitudinal axis of said axle being substantially parallel with the central longitudinal axis of said drum means and spaced from the central axis of the pinion gear, said swinging being such that the reversible electric motor means can be drive engaged or disengaged with said internal ring gear by swinging about said axis whereby to allow said door curtain to be opened manually in the event of power failure by disengaging said drive and further including spring means;

(f) said arm means being biased by said spring means to provide engaged drive between said reversible electric motor means and said internal ring gear and wherein switch means is provided between said arm means and a non-rotatable part of the assembly so that if increased loading is placed on the reversible electric motor means by an obstruction being under the door curtain during closing, then the arm means will swing about said axle and operate said switch means to cause the direction of rotation of the reversible electric motor to change to reopen the door curtain.

6. A roller shutter door as claimed in claim 5 wherein said arm has an integrally attached elongate handle extending therefrom, said handle being swingable to, in turn, cause said arm to swing about said axle whereby to permit manual disengaging of the drive between the reversible electric motor and the internal ring gear and wherein said handle can also swing in a direction generally parallel with the central longitudinal axis of the drum means, said handle means having an opening therein, holding means on a non-movable part of the assembly for locating in said opening when said handle is swung in a direction generally parallel with the longitudinal axis of the drum means and to permit manual disengaging of the drive, said holding means will move out of said opening and locate against a further part of said handle and hold the arm in the electric motor drive disengaged condition.

* * * * *